US011142421B2

(12) United States Patent
Li et al.

(10) Patent No.: US 11,142,421 B2
(45) Date of Patent: Oct. 12, 2021

(54) BONDING MACHINE FOR NEW AND OLD SMT SPLICING BELTS

(71) Applicant: DONGGUAN UNIVERSITY OF TECHNOLOGY, Dongguan (CN)

(72) Inventors: Chuan Li, Dongguan (CN); Jun Deng, Dongguan (CN); Hongjiao Xu, Dongguan (CN); Chuliang He, Dongguan (CN)

(73) Assignee: DONGGUAN UNIVERSITY OF TECHNOLOGY, Dongguan (CN)

( * ) Notice: Subject to any disclaimer, the term of this patent is extended or adjusted under 35 U.S.C. 154(b) by 0 days.

(21) Appl. No.: 16/328,765

(22) PCT Filed: Dec. 23, 2017

(86) PCT No.: PCT/CN2017/118150

§ 371 (c)(1),
(2) Date: Feb. 27, 2019

(87) PCT Pub. No.: WO2018/126918

PCT Pub. Date: Jul. 12, 2018

(65) Prior Publication Data

US 2019/0210828 A1 Jul. 11, 2019

(30) Foreign Application Priority Data

Jan. 3, 2017 (CN) ..... 201710001848.X

(51) Int. Cl.
*B65H 19/18* (2006.01)
*B65H 21/00* (2006.01)

(52) U.S. Cl.
CPC ..... *B65H 19/181* (2013.01); *B65H 19/1836* (2013.01); *B65H 21/00* (2013.01);
(Continued)

(58) Field of Classification Search
CPC ..... B65H 2301/4622; B65H 2301/4631
See application file for complete search history.

(56) References Cited

U.S. PATENT DOCUMENTS 3,434,400 A * 3/1969 Hochfeld ..... B31D 5/04 493/417
4,082,592 A * 4/1978 Raabe ..... B29C 65/5057 156/153

(Continued)

FOREIGN PATENT DOCUMENTS

CN 203359622 12/2013
CN 204917355 12/2015

(Continued)

*Primary Examiner* — Mark A Osele
(74) *Attorney, Agent, or Firm* — Law Offices of Steven W. Weinrieb

(57) ABSTRACT

The present invention relates to the field of SMT splicing belt processing equipment, and more particularly to a bonding machine for new and old SMT splicing belts. The machine comprises a supporting plate for supporting the old and new splicing belts, conveying devices for conveying the old and new splicing belts toward one another, and a bonding mechanism for bonding the old and new splicing belts together, the conveying devices and the bonding mechanism both being connected to a controller.

8 Claims, 6 Drawing Sheets

(52) U.S. Cl.
CPC ..... *B65H 2301/4622* (2013.01); *B65H 2301/4631* (2013.01); *B65H 2601/511* (2013.01); *B65H 2701/1722* (2013.01)

(56) References Cited

U.S. PATENT DOCUMENTS

| | | | | |
|---|---|---|---|---|
| 4,685,392 | A | 8/1987 | Kaneda | |
| 4,765,862 | A * | 8/1988 | Azuma | B29C 65/00 156/304.1 |
| 4,867,835 | A * | 9/1989 | Poole | B29C 65/20 156/507 |
| 5,795,431 | A * | 8/1998 | Weissfloch | B29C 65/7894 156/304.6 |
| 7,328,734 | B2 * | 2/2008 | Bacik | B29C 37/04 156/304.2 |
| 8,052,832 | B2 * | 11/2011 | Tiefel | B65H 19/1852 156/304.1 |
| 9,188,192 | B2 * | 11/2015 | Cancienne, Jr. | F16G 3/006 |
| 9,302,439 | B2 * | 4/2016 | Pan | B29C 66/1142 |
| 9,796,135 | B2 * | 10/2017 | Guttenberg | B29C 66/8222 |
| 2011/0067801 | A1 * | 3/2011 | van't Schip | B29C 65/1412 156/157 |

FOREIGN PATENT DOCUMENTS

| | | |
|---|---|---|
| CN | 105751554 | 7/2016 |
| CN | 106809678 | 6/2017 |
| CN | 106865300 | 6/2017 |
| JP | 2012116601 | 6/2012 |
| JP | 2014133616 | 7/2014 |

* cited by examiner

BONDING MACHINE FOR NEW AND OLD SMT SPLICING BELTS

FIELD OF THE INVENTION

The present invention relates generally to the field of SMT splicing belt processing equipment, and in particular, to a bonding machine for new and old SMT splicing belts.

BACKGROUND OF THE INVENTION

With the development of the electronic equipment, the application of the splicing belt becomes more and more extensive and the quantity demanded thereof is increasing day by day. Compared with the shutdown splicing, the splicing belt can be achieved to splice without downtime during the processing of the electronic equipment splices, which greatly reduces the splicing time and improves the splicing efficiency, thereby greatly lowering the cost of splicing.

With the time goes by, the splicing belt will be damaged and it often seems that a part of damage leads to scrap the whole one, thereby relatively increasing the splicing cost. Therefore, how to reuse the damaged splicing belt so that the splicing cost can be saved has become a research direction.

The present invention aims to provide the bonding machine for new and old SMT splicing belts; new and old splicing belts are conveyed to the center through the new splicing belt conveying device and the old splicing belt conveying device, and the new splicing belts and the old splicing belts are bonded through the bonding mechanism, so that the old splicing belts can be recycled without damaging the splicing effects of the splicing belts, and therefore, the splicing cost is reduced to certain extent.

In order to achieve the objective above, the technical solutions adopted in the present invention are as follow:

A bonding machine for new and old SMT splicing belts, comprising a supporting plate (1), in which a new splicing belt conveying device (3) and an old splicing belt conveying device (4) which are opposite are arranged on the supporting plate (1), and both the two sides of two groups of conveying devices are equipped with limiting blocks (9) which are matched with splicing belts, a jacking device (8) matched with the splicing belts is arranged on the top of the supporting plate (1), a bonding mechanism (7) matched with the splicing belts is arranged above the jacking device (8), and the new splicing belt conveying device (3), the old splicing belt conveying device (4), the jacking device (8) and the bonding mechanism (7) are connected to a controller.

Further, the new splicing belt conveying device (3) and the old splicing belt conveying device (4) share a front conveying bracket (2), the front conveying bracket (2) is connected with two conveying and regulating plates (14) which are symmetrical in the center thereof and run forward and backward, the conveying and regulating plate (14) is arranged on a conveying movable block (13), the conveying movable block (13) is matched with a conveying and regulating slide rail (15) of forward and backward direction on the supporting plate (1) and is fixedly connected with a conveying and regulating belt (12), the conveying and regulating belt (12) is matched with a conveying and regulating motor (11) on the supporting plate (1), and the conveying and regulating motor (11) are connected to a controller.

Further, the jacking device (8) comprises a jacking and lifting device (10) arranged on the front and rear parts of the supporting plate (1), the jacking and lifting device (10) on the front part is connected with a jacking movable chute seat (19), the jacking and lifting device (10) on the rear part is matched with a jacking and lifting seat (17) through a slide rail, the jacking and lifting seat (17) is provided with a jacking movable cylinder (16), the jacking movable cylinder (16) is connected with a jacking block (18) matched with the splicing belt and the front end of the jacking block (18) is matched with the jacking movable chute seat (19), and the jacking and lifting device (10) and the jacking movable cylinder (16) are connected to a controller.

Further, the bonding mechanism (7) comprises a bonding seat (21) on the supporting plate (1), the bonding seat (21) is provided with a bonding screw rod seat (23), the bonding screw rod seat (23) is provided with a bonding front and rear movable screw rod (24), the bonding front and rear movable screw rod (24) is connected with a bonding front and rear movable motor (22) on the bonding seat (21) through the synchronous belt and the synchronous wheel, the bonding front and rear movable screw rod (24) is sleeved with a bonding front and rear movable seat (25) matched with thereof and the bonding front and rear movable seat (25) is matched with a bonding front and rear movable slide rail (20) arranged on the bonding seat (21), the bonding front and rear movable seat (25) is provided with a tape dispenser (26), the tape dispenser (26) is provide with a tape reel (28) and a rubberizing device (27) matched with the splicing belt is arranged on the lower part of the tape dispenser (26), and the bonding front and rear movable motor (22) and the rubberizing device (27) is connected to the controller.

Further, the rubberizing device (27) comprises a tape feeding device (35) arranged under the tape dispenser (26) and a tape pressing device (34) arranged under and matched with thereof, the tape feeding device (35) comprises a tape feeding seat (36), the tape feeding seat (36) is internally provided with a tape feeding motor (37) and a guide tube (38) matched with the tape reel (28), the lower part of the guide tube (38) is provide with a first tape feeding tube (39) matched with thereof and a pressing tube (41) matched with the first tape feeding tube (39), the first tape feeding tube (39) is connected to a tape feeding motor (37) through the synchronous belt and the synchronous wheel, and the tape pressing device (34) and the tape feeding motor (37) are connected to the controller.

Further, the lower part of the first tape feeding tube (39) is provided with a second tape feeding tube (40), the second tape feeding tube (40) is matched with the pressing tube (41), and the second tape feeding tube (40) and the first tape feeding tube (39) are connected to the tape feeding motor (37) through the same synchronous wheel, the side of the tape feeding seat (36) is provided with a tensioning wheel (42) matched with the synchronous belt, both the first tape feeding tube (39) and the second tape feeding tube (40) are composed of circular blocks according to a certain spacing, and their gaps are complementary.

Further, the pressing tube (41) is installed on a pressing seat (43) under the tape feeding seat (36) and the pressing seat (43) is provided with and matched with a regulating tank (44), the end part of the pressing tube (41) is connected with a regulating bolt (47) through a tension spring (46), the regulating bolt (47) is matched with a regulating hole (45) on the pressing seat (43), and the pressing seat (43) is provided with no less than two regulating hole (45).

Further, the tape pressing device (34) comprises a tape pressing seat (49) under the tape feeding seat (36), the rear side of the tape pressing seat (49) is provided with a tape guiding block (50) matched with the tape, the lower part thereof is provided with a tape pressing tube (52) and a tape cutting port (51) in order from the front to the rear, the tape pressing seat (49) is provided with a conveying shaft (53) connected with the tape pressing motor, the conveying shaft (53) is connected with a cam shaft (54) through the synchronous belt and the synchronous wheel, the cam shaft (54) is provided with a tape cutting cam (55), the tape cutting cam (55) is connected with a tape cutter (56) matched with the tape cutting port (51), and the tape pressing motor is connected to the controller.

Further, the tape pressing seat (49) is arranged on the rubberizing lifting seat (32) and the position where the rubberizing lifting seat (32) is located in the rear side of the tape pressing seat (49) is provided with a radiator (48), the rubberizing lifting seat (32) is fixedly connected with a rubberizing lifting block (31), the rubberizing lifting block (31) is sleeved on a rubberizing lifting screw rod (30) which is on the tape feeding seat (36), the rubberizing lifting screw rod (30) is connected with a rubberizing lifting motor (29) on the tape feeding seat (36) through the synchronous wheel and the synchronous belt, the rubberizing lifting seat (32) is matched with a rubberizing lifting slide block (33) on the tape feeding seat (36), and the radiator (48) and the rubberizing lifting motor (29) are connected to the controller.

The advantageous effects of the present invention are as follows:

New and old splicing belts are conveyed to the center through the new splicing belt conveying device and the old splicing belt conveying device, and the new splicing belts and the old splicing belts are bonded through the bonding mechanism, so that the old splicing belts can be recycled without damaging the splicing effects of the splicing belts, and therefore, the splicing cost is reduced to certain extent.

The front and rear positions of the front conveying bracket can be regulated through the conveying and regulating plate so that the width of the new and old conveying brackets can be regulated and the bonding of splicing belts in different specifications can be adapted.

The jacking device is simple in structure, convenient in operation and meanwhile is able to jack the sewing part of the new and old splicing belt well so that better bonding thereof could be achieved.

The bonding mechanism enables the rubberizing device to be regulated front and rear through the bonding front and rear movable screw rod so that the bonding of two splicing belt can be completed at one time, which is simple in structure, convenient in operation and accurate in front and rear movement.

The tape feeding device is simple in structure, convenient in operation and is able to pull the tape out of the roll effectively.

The design of the second tape feeding tube and its complementary design with the first tape feeding tube are able to pull the tape twice by using the same pressing tube, greatly improving the tape feeding efficiency, and the design of the tensioning wheel enables that the synchronous belt which drives the first tape feeding tube and the second tape feeding tube is always in a tensioning state.

The position of the pressing tube can be regulated in the regulating tank, and the positioning of the pressing tube after regulation can be achieved through the regulating bolt matched with different regulating hole so that the pressing tube can be regulated according to the tapes of different specifications to achieve better tape feeding effects.

The tape pressing device is simple in structure and enables the tape to be fallen down vertically by the tape guiding block, which is convenient for the tape pressing tube to press the tape, and meanwhile that the upper and lower movements of the tape cutter are achieved through the cam greatly facilitates the tape cutting operation.

The tape pressing device is arranged above the rubberizing lifting seat so that the tape pressing device is achieved to be lifted by the rubberizing lifting screw rod, greatly improve the accuracy of the tape pressing.

DETAILED DESCRIPTION OF THE ILLUSTRATED EMBODIMENT

The text markup shown in the figures are indicated as follows:

1—supporting plate;
2—front conveying bracket;
3—new splicing belt conveying device;
4—old splicing belt conveying device;
5—conveying and regulating device;
7—bonding mechanism;
8—jacking device;
9—limiting block;
10—jacking and lifting device;
11—conveying and regulating motor;
12—conveying and regulating belt;
13—conveying movable block;
14—conveying and regulating plate;
15—conveying and regulating slide rail;
16—jacking movable cylinder;
17—jacking and lifting seat;
18—jacking block;
19—jacking movable chute seat;
20—bonding front and rear movable slide rail;
21—bonding seat;
22—bonding front and rear movable motor;
23—bonding screw rod seat;
24—bonding front and rear movable screw rod;
25—bonding front and rear movable seat;
26—tape dispenser;
27—rubberizing device;
28—tape reel;
29—rubberizing lifting motor;
30—rubberizing lifting motor;
31—rubberizing lifting block;
32—rubberizing lifting seat;
33—rubberizing lifting slide block;
34—tape pressing device;
35—tape feeding device;
36—tape feeding seat;
37—tape feeding motor;

38—guide tube;
39—first tape feeding tube;
40—second tape feeding tube;
41—pressing tube;
42—tensioning wheel;
43—pressing seat;
44—regulating tank;
45—regulating hole;
46—tension spring;
47—regulating bolt;
48—radiator;
49—tape pressing seat;
50—tape guiding block;
51—tape cutting port;
52—tape pressing tube;
53—conveying shaft;
54—cam shaft;
55—tape cutting cam;
56—tape cutter.

In order to enable the technicians in the art to better understand the technical solutions in the present invention, the following is a detailed description of the present invention combined with the accompanying drawings. The description in this part is only for demonstration and explanation, and should not limit the scope of protection of the present invention.

Figure 1:
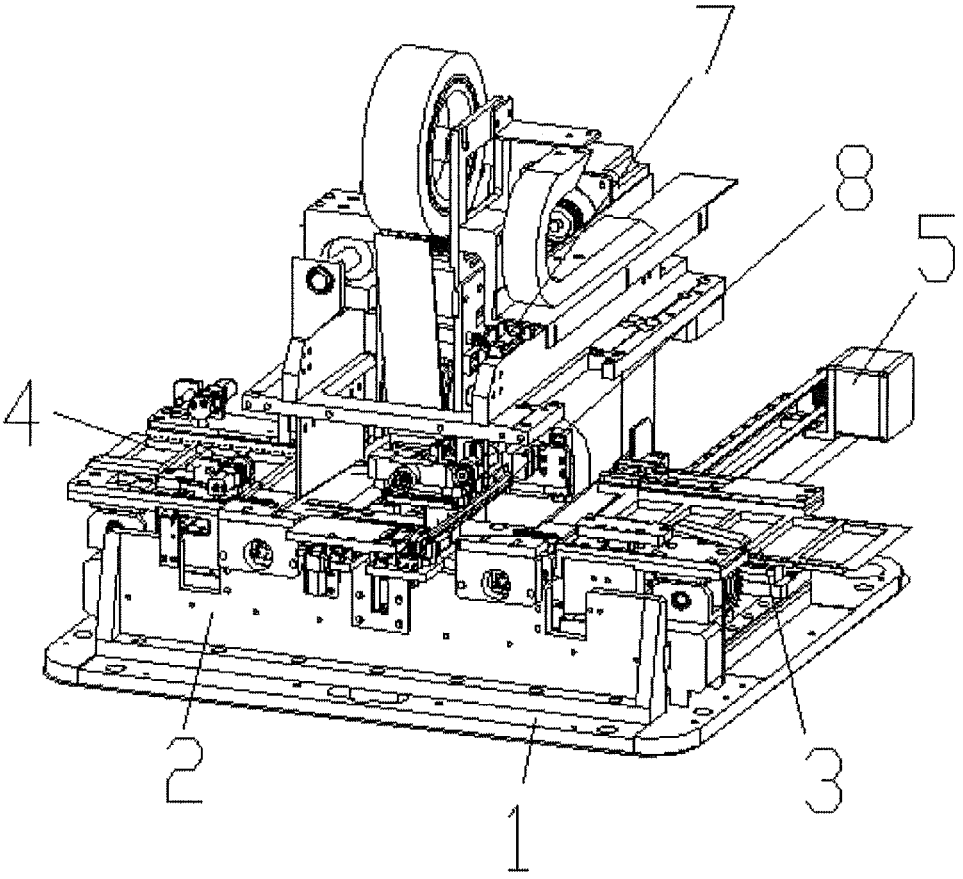
FIG. 1 is a stereoscopic schematic view of a bonding machine for new and old SMT splicing belts.
Figure 2:
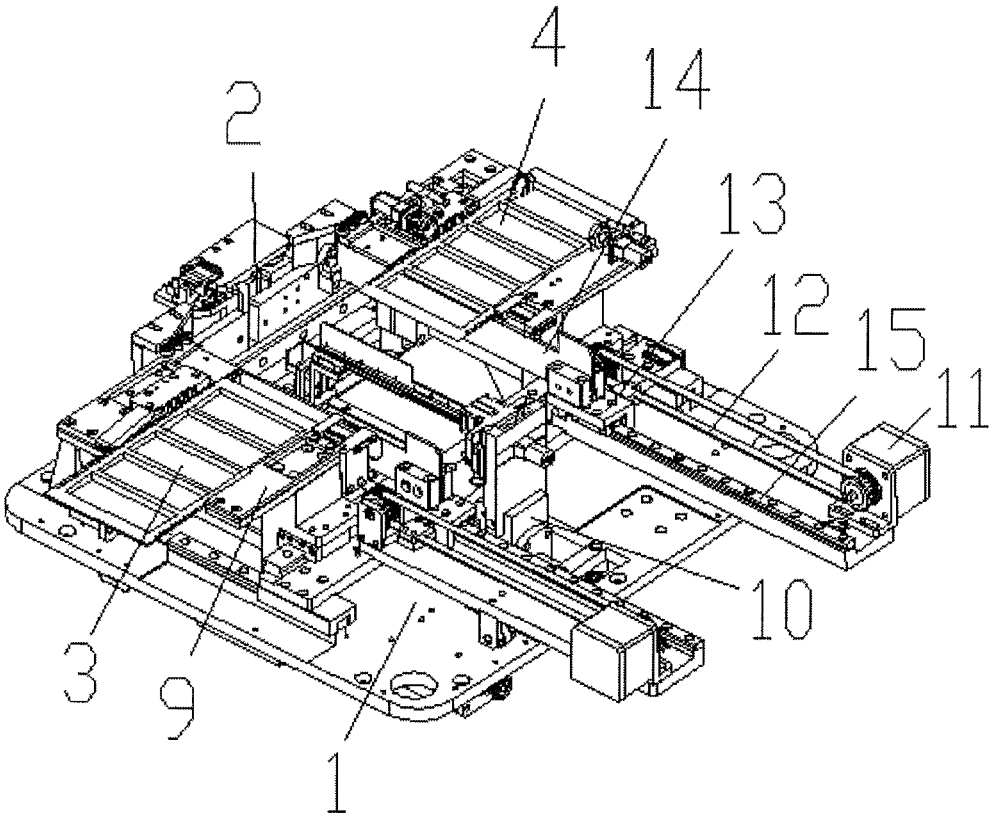
FIG. 2 is a stereoscopic schematic view of the conveying part for new and ole splicing belts.
Figure 3:
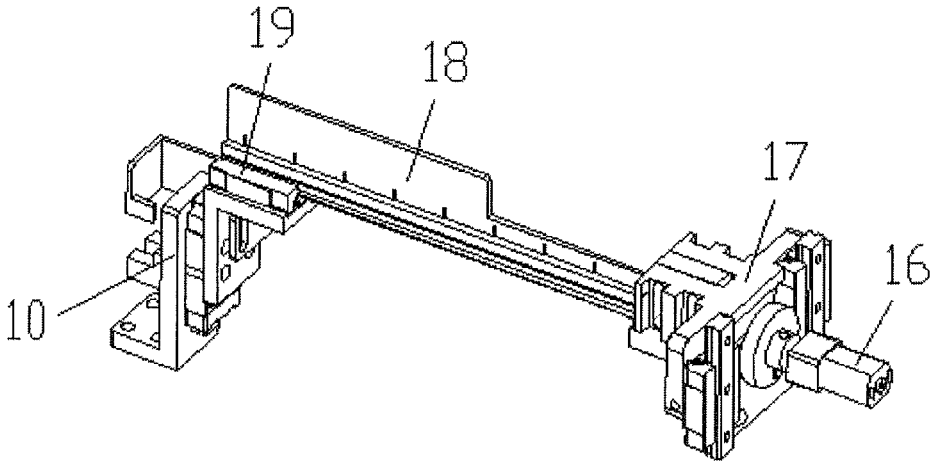
FIG. 3 is a stereoscopic schematic view of the jacking device.
Figure 4:
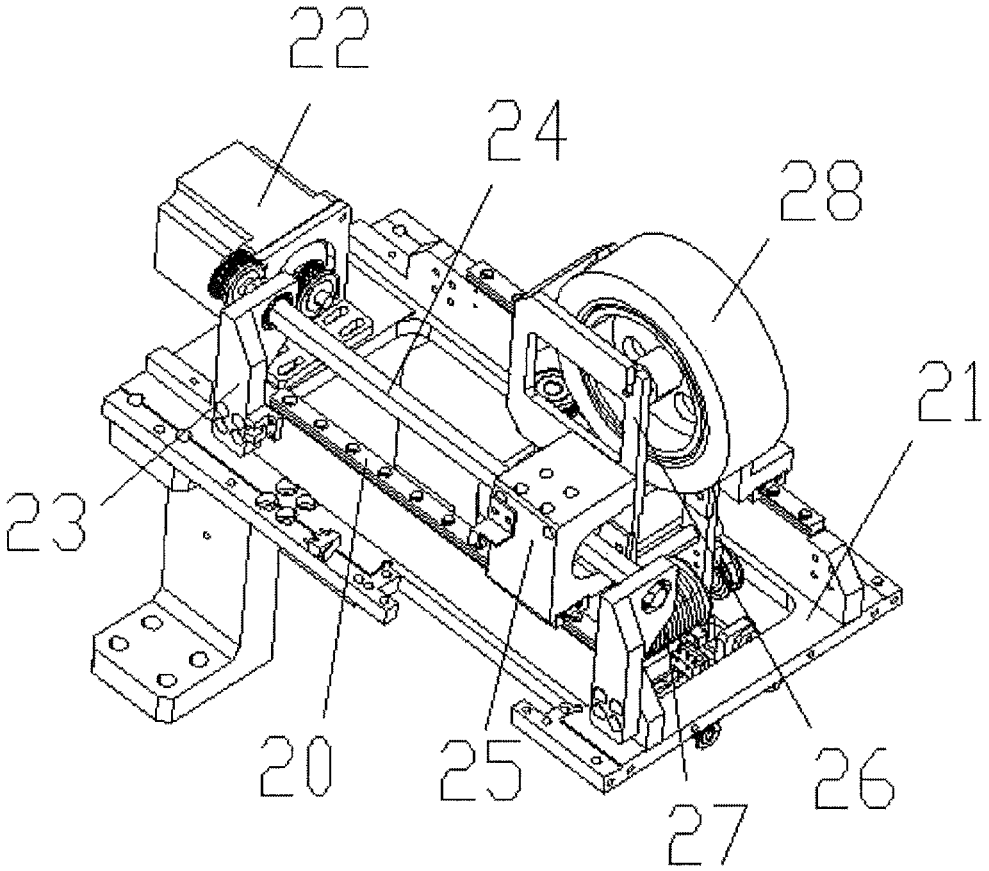
FIG. 4 is a stereoscopic schematic view of the bonding mechanism.
Figure 5:
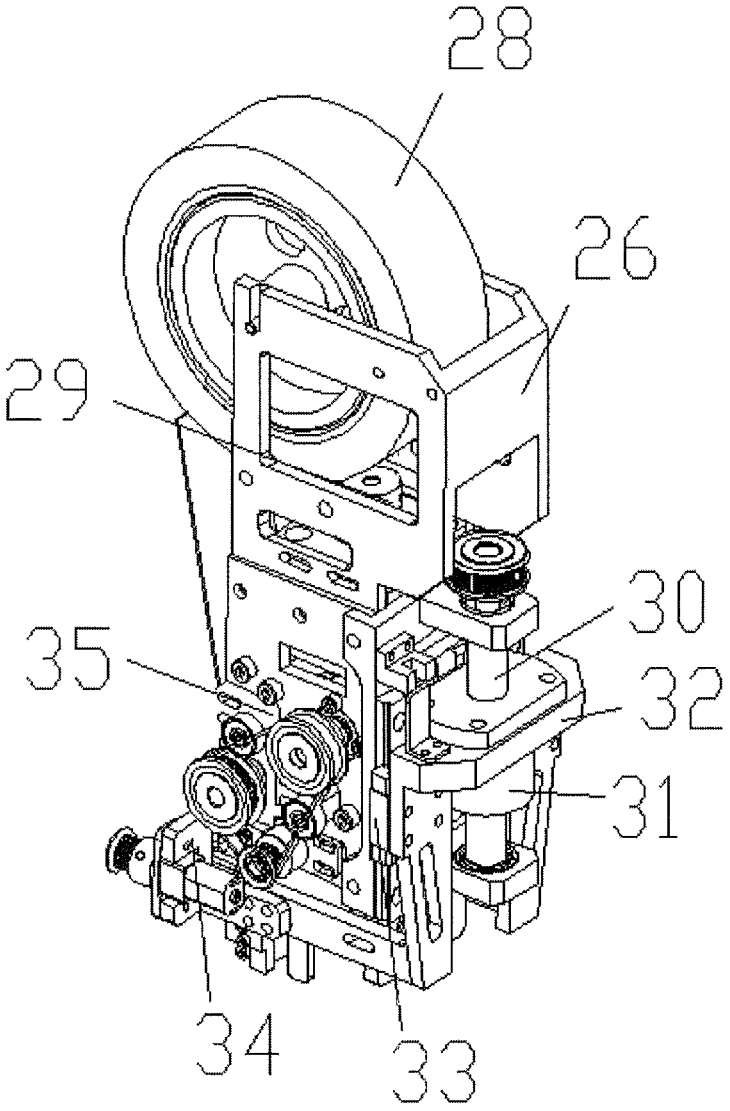
FIG. 5 is a stereoscopic schematic view of the rubberizing device.
Figure 6:
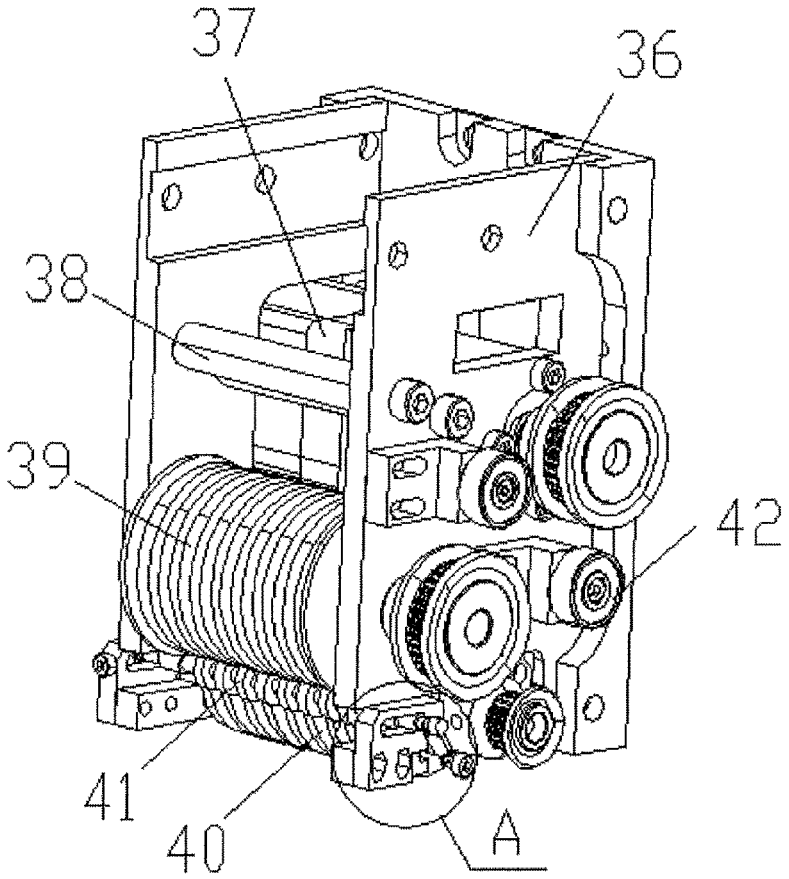
FIG. 6 is a stereoscopic schematic view of the tape feeding device.
Figure 7:
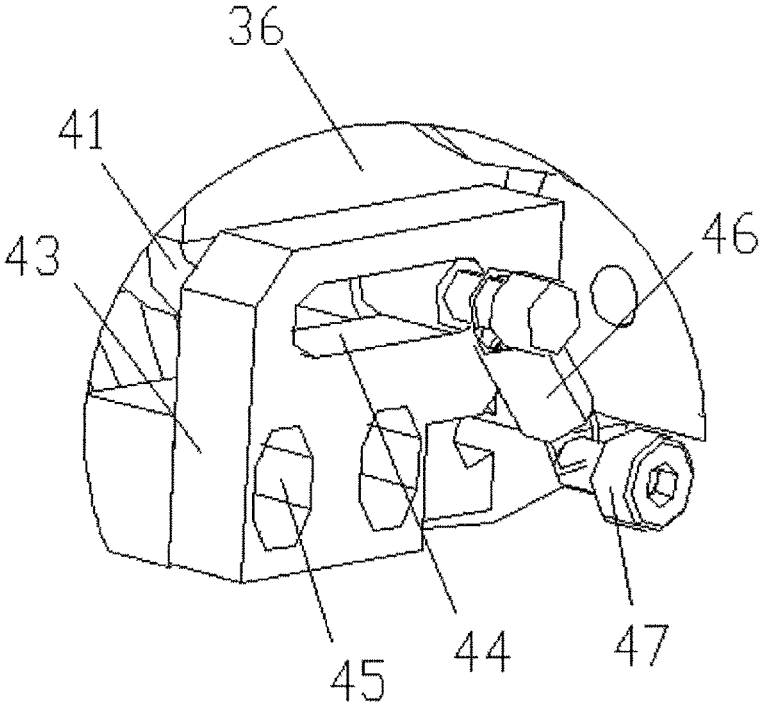
FIG. 7 is a partial enlarged view of the A in the FIG. 6.
Figure 8:
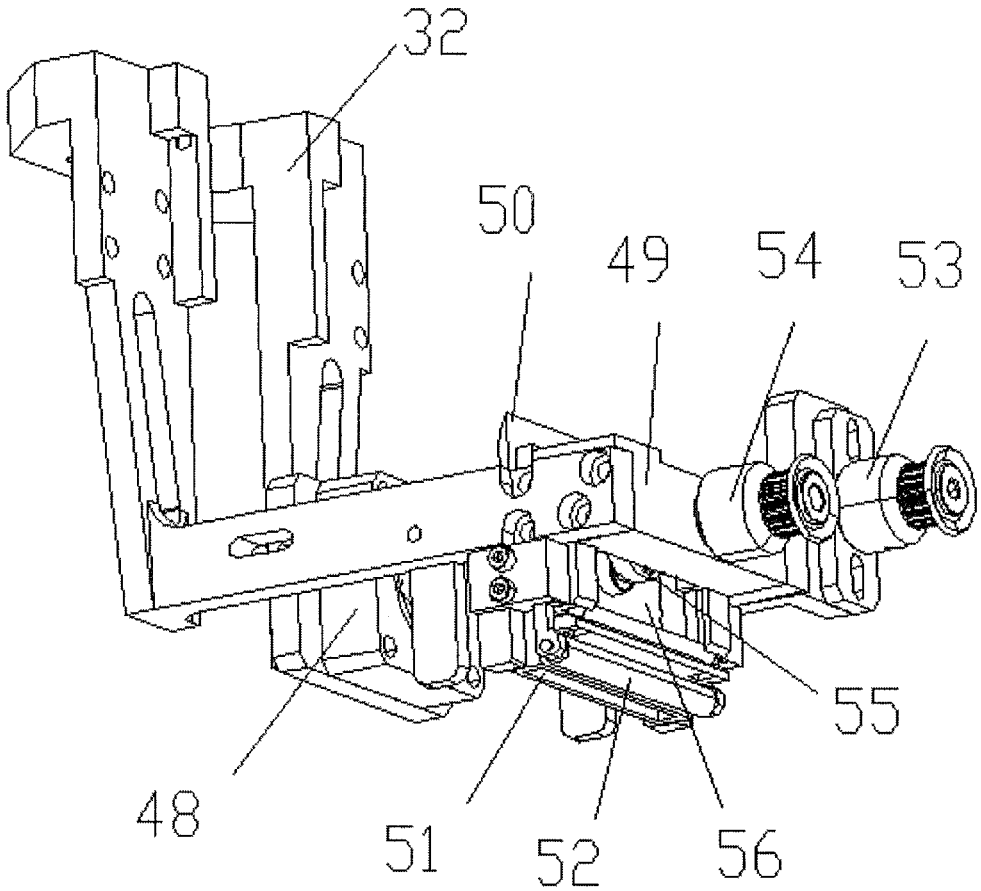
FIG. 8 is a stereoscopic schematic view of the tape pressing device.

As shown in the FIGS. 1-8, the specific structure of the present invention is as follows:

A bonding machine for new and old SMT splicing belts, comprising a supporting plate (1), in which a new splicing belt conveying device (3) and an old splicing belt conveying device (4) which are opposite are arranged on the supporting plate (1), and both the two sides of two groups of conveying devices are equipped with limiting blocks (9) which are matched with splicing belts, a jacking device (8) matched with the splicing belts is arranged on the top of the supporting plate (1), a bonding mechanism (7) matched with the splicing belts is arranged above the jacking device (8), and the new splicing belt conveying device (3), the old splicing belt conveying device (4), the jacking device (8) and the bonding mechanism (7) are connected to a controller.

Preferentially, the new splicing belt conveying device (3) and the old splicing belt conveying device (4) share a front conveying bracket (2), the front conveying bracket (2) is connected with two conveying and regulating plates (14) which are symmetrical in the center thereof and run forward and backward, the conveying and regulating plate (14) is arranged on a conveying movable block (13), the conveying movable block (13) is matched with a conveying and regulating slide rail (15) of forward and backward direction on the supporting plate (1) and is fixedly connected with a conveying and regulating belt (12), the conveying and regulating belt (12) is matched with a conveying and regulating motor (11) on the supporting plate (1), and the conveying and regulating motor (11) are connected to a controller.

Preferentially, the jacking device (8) comprises a jacking and lifting device (10) arranged on the front and rear parts of the supporting plate (1), the jacking and lifting device (10) on the front part is connected with a jacking movable chute seat (19), the jacking and lifting device (10) on the rear part is matched with a jacking and lifting seat (17) through a slide rail, the jacking and lifting seat (17) is provided with a jacking movable cylinder (16), the jacking movable cylinder (16) is connected with a jacking block (18) matched with the splicing belt and the front end of the jacking block (18) is matched with the jacking movable chute seat (19), and the jacking and lifting device (10) and the jacking movable cylinder (16) are connected to a controller.

Preferentially, the bonding mechanism (7) comprises a bonding seat (21) on the supporting plate (1), the bonding seat (21) is provided with a bonding screw rod seat (23), the bonding screw rod seat (23) is provided with a bonding front and rear movable screw rod (24), the bonding front and rear movable screw rod (24) is connected with a bonding front and rear movable motor (22) on the bonding seat (21) through the synchronous belt and the synchronous wheel, the bonding front and rear movable screw rod (24) is sleeved with a bonding front and rear movable seat (25) matched with thereof and the bonding front and rear movable seat (25) is matched with a bonding front and rear movable slide rail (20) arranged on the bonding seat (21), the bonding front and rear movable seat (25) is provided with a tape dispenser (26), the tape dispenser (26) is provide with a tape reel (28) and a rubberizing device (27) matched with the splicing belt is arranged on the lower part of the tape dispenser (26), and the bonding front and rear movable motor (22) and the rubberizing device (27) is connected to the controller.

Preferentially, the rubberizing device (27) comprises a tape feeding device (35) arranged under the tape dispenser (26) and a tape pressing device (34) arranged under and matched with thereof, the tape feeding device (35) comprises a tape feeding seat (36), the tape feeding seat (36) is internally provided with a tape feeding motor (37) and a guide tube (38) matched with the tape reel (28), the lower part of the guide tube (38) is provide with a first tape feeding tube (39) matched with thereof and a pressing tube (41) matched with the first tape feeding tube (39), the first tape feeding tube (39) is connected to a tape feeding motor (37) through the synchronous belt and the synchronous wheel, and the tape pressing device (34) and the tape feeding motor (37) are connected to the controller.

Preferentially, the lower part of the first tape feeding tube (39) is provided with a second tape feeding tube (40), the second tape feeding tube (40) is matched with the pressing tube (41), and the second tape feeding tube (40) and the first tape feeding tube (39) are connected to the tape feeding motor (37) through the same synchronous wheel, the side of the tape feeding seat (36) is provided with a tensioning wheel (42) matched with the synchronous belt, both the first tape feeding tube (39) and the second tape feeding tube (40) are composed of circular blocks according to a certain spacing, and their gaps are complementary.

Preferentially, the pressing tube (41) is installed on a pressing seat (43) under the tape feeding seat (36), and the pressing seat (43) is provided with and matched with a regulating tank (44), the end part of the pressing tube (41) is connected with a regulating bolt (47) through a tension spring (46), the regulating bolt (47) is matched with a regulating hole (45) on the pressing seat (43) and the pressing seat (43) is provided with no less than two regulating hole (45).

Preferentially, the tape pressing device (34) comprises a tape pressing seat (49) under the tape feeding seat (36), the rear side of the tape pressing seat (49) is provided with a tape guiding block (50) matched with the tape, the lower part thereof is provided with a tape pressing tube (52) and a tape cutting port (51) in order from the front to the rear, the tape pressing seat (49) is provided with a conveying shaft (53) connected with the tape pressing motor, the conveying shaft (53) is connected with a cam shaft (54) through the synchronous belt and the synchronous wheel, the cam shaft (54) is provided with a tape cutting cam (55), the tape cutting cam (55) is connected with a tape cutter (56) matched with the tape cutting port (51), and the tape pressing motor is connected to the controller.

Preferentially, the tape pressing seat (49) is arranged on the rubberizing lifting seat (32) and the position where the rubberizing lifting seat (32) is located in the rear side of the tape pressing seat (49) is provided with a radiator (48), the rubberizing lifting seat (32) is fixedly connected with a rubberizing lifting block (31), the rubberizing lifting block (31) is sleeved on a rubberizing lifting screw rod (30) which is on the tape feeding seat (36), the rubberizing lifting screw rod (30) is connected with a rubberizing lifting motor (29) on the tape feeding seat (36) through the synchronous wheel and the synchronous belt, the rubberizing lifting seat (32) is matched with a rubberizing lifting slide block (33) on the tape feeding seat (36), and the radiator (48) and the rubberizing lifting motor (29) are connected to the controller.

When the bonding machine for new and old SMT splicing belts is used specifically, the device is installed firstly, and then the conveying and regulating belt (12) is driven to move by the conveying and regulating motor (11) so that the conveying movable block (13) is driven to move and the front conveying bracket (2) is driven to move by the conveying and regulating plate (14), which enables the specification of the conveying device for new and old splicing belts is regulated, after then the new and old splicing belts are respectively put onto the new splicing belt conveying device (3) and the old splicing belt conveying device(4) so that the new and ole splicing belts are driven to convey to the center and the bonding front and rear movable seat (25) is driven to move forward, thereby driving the rubberizing device (27) to move forward, after that, the tape feeding motor (37) is controlled to work so that the first tape feeding tube (39) and the second tape feeding tube (40) are rotated, thereby making the tape on the tape reel (28) pass through the guide tube (38) first then be send out from the position where the first tape feeding tube (39) and the second tape feeding tube (40) are matched with the pressing tube (41), and the tape is made to fall down vertically by the tape guiding block (50) passing through the tape pressing device (34), after that then, the rubberizing lifting seat (32) is lifted to a suitable position by the rubberizing lifting motor (3) driven by the rubberizing lifting motor (29) so that the tape pressing device (34) is placed at a suitable position, then the bonding front and rear movable seat (25) is driven to move backward by the bonding front and rear movable screw rod (24) controlled by the bonding front and rear movable motor (22), thereby driving the whole rubberizing device (27) to move backward and enabling the tape pressing tube (52) to press the tape onto the bonding position of the new and old splicing belts from the front to the rear, and therefore, the bonding of the new and old splicing belts is completed.

It should be understood that in the present invention the term "comprises", "comprising" or any other variants thereof is intended to encompass a non-exclusive inclusion, such that a process, method, article, or device that comprises a plurality of elements includes not only those elements but also other elements that are not explicitly listed, or elements that are inherent to such a process, method, item, or device.

The principles and embodiments of the present invention have been described herein with reference to specific examples, and the description of the above examples is only to aid in understanding the method of the present invention and its core idea. The above description is only a preferred embodiment of the present invention, and it should be noted that due to the finiteness of the textual expression, there is an infinitely specific structure objectively. It will be apparent to those skilled in the art that a number of modifications, modifications, or variations may be made without departing from the principles of the invention, and the technical features described above may be combined in an appropriate manner; These improvements, modifications, or combinations, or the direct application of the inventive concepts and technical solutions to other applications without modification, should all be considered to be within the scope of the present invention.

What is claimed is:

1. A bonding machine for new and old SMT splicing belts, comprising:

a supporting plate;

a new splicing belt conveying device for conveying a new splicing belt, and an old splicing belt conveying device for conveying an old splicing belt, wherein said new splicing belt conveying device and said old splicing belt conveying device are disposed upon opposite sides of said supporting plate;

a pair of limiting blocks operatively connected to said new and old splicing belts;

a jacking device operatively connected to said new and old splicing belts and mounted atop said supporting plate;

a bonding mechanism operatively connected to said new and old splicing belts and disposed above said jacking device;

wherein said new splicing belt conveying device and said old splicing belt conveying device share a front conveying bracket;

wherein said front conveying bracket is connected to two conveying and regulating plates which are symmetrically disposed with respect to each other and with respect to said front conveying bracket at central locations of said front conveying bracket and which extend forwardly and backwardly;

wherein said two conveying and regulating plates are disposed upon a movable conveying block;

wherein said movable conveying block is mounted upon a conveying and regulating slide rail which moves forwardly and backwardly upon said supporting plate and is operatively connected to a conveying and regulating belt;

wherein said conveying and regulating belt is operatively connected to a conveying and regulating motor which is mounted upon said supporting plate; and wherein said jacking device, said bonding mechanism, and said conveying and regulating motor are all operatively connected to a controller.

2. The bonding machine for new and old SMT splicing belts as set forth in claim 1, wherein:

said jacking device comprises a jacking and lifting device having first and second portions mounted upon forward and rearward portions of said supporting plate;

wherein said first portion of said jacking and lifting device mounted upon said front portion of said supporting plate is connected to a jacking movable chute seat;

wherein said second portion of said jacking and lifting device mounted upon said rear portion of said supporting plate is connected to a jacking and lifting seat through a slide rail;

wherein said jacking and lifting seat is provided with a jacking movable cylinder which is connected with a jacking block which is operatively connected to at least one of said new and old splicing belts;

wherein said front end of said jacking block is operatively connected to said jacking movable chute seat; and wherein said jacking and lifting device and said jacking movable cylinder are operatively connected to said controller.

3. The bonding machine for new and old SMT splicing belts as set forth in claim 1, wherein:

said bonding mechanism comprises a bonding seat mounted upon said supporting plate;

wherein said bonding seat is provided with a bonding screw rod seat;

wherein said bonding screw rod seat is provided with a rotatable bonding screw rod;

wherein said rotatable bonding screw rod is operatively connected to a drive motor mounted upon said bonding seat;

wherein said rotatable bonding screw rod is sleeved within a movable seat which is slidably movable along a slide rail which is fixedly mounted upon said bonding seat;

wherein said movable seat is provided with a tape dispenser;

wherein said tape dispenser is provided with a tape reel and a tape feeding device operatively connected to one of said new and old splicing belts disposed within a lower portion of said tape dispenser; and wherein said drive motor and said tape feeding device are operatively connected to said controller.

4. The bonding machine for new and old SMT splicing belts as set forth in claim 3, wherein:

said tape feeding device is disposed beneath said tape dispenser, and a tape pressing device is disposed beneath said tape feeding device and operatively cooperative therewith;

wherein said tape feeding device comprises a tape feeding seat which is internally provided with a tape feeding motor and a guide shaft;

wherein a first tape feeding roller is disposed within said tape feeding seat, and a pressing roller is also disposed within said tape feeding seat so as to operatively cooperate with said first tape feeding roller;

wherein said first tape feeding roller is operatively connected to said tape feeding motor; and wherein said tape pressing device and said tape feeding motor are operatively connected to said controller.

5. The bonding machine for new and old SMT splicing belts as set forth in claim 4, wherein:

a lower peripheral portion of said first tape feeding roller is operatively associated with said pressing roller, while an upper peripheral portion of a second tape feeding roller is operatively associated with said pressing roller;

wherein said second tape feeding roller and said first tape feeding roller are operatively connected to said tape feeding motor;

wherein a side portion of said tape feeding seat is provided with a tensioning wheel; and wherein said first tape feeding roller and said second tape feeding roller are spaced from each other as a result of being disposed upon opposite sides of said pressing roller.

6. The bonding machine for new and old SMT splicing belts as set forth in claim 4, wherein:

said pressing roller is mounted upon a pressing seat located beneath said tape feeding seat;

said pressing seat is provided with a regulating slot;

an end portion of said pressing roller is connected to a regulating bolt through a tension spring;

said regulating bolt is disposed within at least one regulating hole defined within said pressing seat; and said pressing seat is provided with no less than two regulating holes.

7. The bonding machine for new and old SMT splicing belts as set forth in claim 4, wherein:

said tape pressing device comprises a tape pressing seat disposed beneath said tape feeding seat;

a rear side portion of said tape pressing seat is provided with a tape guiding block;

a lower portion of said tape pressing seat is provided with a tape pressing roller and a tape cutting port;

said tape pressing seat is also provided with a conveying shaft which is connected with a cam shaft; and said cam shaft is provided with a tape cutting cam which is connected with a tape cutter which is adapted to operatively cooperate with said tape cutting port.

8. The bonding machine for new and old SMT splicing belts as set forth in claim 7, wherein:

a rear portion of said tape pressing seat is mounted upon a lower portion of a lifting seat;

said rear portion of said tape pressing seat is provided with a radiator;

said lifting seat is fixedly connected with a lifting block;

said lifting block is sleeved around a lifting screw rod which is disposed upon said tape feeding seat;

said lifting screw rod is operatively connected to a lifting motor disposed upon said tape feeding seat;

said lifting seat is operatively associated with a lifting slide block which is disposed upon said tape feeding seat; and sad radiator and said lifting motor are operatively connected to said controller.

* * * * *